United States Patent [19]

Schregenberger

[11] 4,346,722

[45] Aug. 31, 1982

[54] APPARATUS USED IN THE TREATMENT OF CANS

[75] Inventor: Alex J. Schregenberger, Neshanic, N.J.

[73] Assignee: Midland-Ross Co., Cleveland, Ohio

[21] Appl. No.: 11,221

[22] Filed: Feb. 12, 1979

[51] Int. Cl.[3] ..... B08B 3/00

[52] U.S. Cl. ..... 134/62; 134/66; 134/79; 134/134; 134/152; 134/170; 118/317; 118/319; 198/599; 198/608

[58] Field of Search ..... 134/43, 62, 66, 79, 134/114, 134, 137, 142, 151, 152, 153, 154, 170, 171, 21, 23, 30, 33; 15/302; 156/641, 650; 427/236; 118/317, 319; 198/599, 608

[56] References Cited

U.S. PATENT DOCUMENTS

| | | | |
|---|---|---|---|
| 3,302,655 | 2/1967 | Sasaki et al. | 134/134 X |
| 3,311,500 | 3/1967 | Seto | 134/23 |
| 3,486,939 | 12/1969 | Pinckard | 134/62 |
| 3,607,546 | 9/1971 | Grealy | 134/134 X |
| 3,854,445 | 12/1974 | Stolle | 134/152 |
| 3,861,409 | 1/1975 | Taniguchi | 134/43 |
| 4,074,654 | 2/1978 | Noguchi et al. | 134/62 X |

*Primary Examiner*—S. Leon Bashore, Jr.
*Assistant Examiner*—Michael Goldman
*Attorney, Agent, or Firm*—Harlan E. Hummer

[57] ABSTRACT

An apparatus, used in the treatment of cans, is made up of a number of individual units, each of which essentially comprises a pair of drums that are mounted for rotation about parallel axes which are vertically disposed. One of the drums is used in the treatment of the interior of the cans, while the other is utilized in the treatment of the exterior of the cans. Each of the rotary drums is provided with means for holding a number of cans in circumferential alignment around the outer periphery of the drum such that the longitudinal axes of the cans are radially oriented relative to the rotational axes of the drums. Other means are provided to successively transfer the cans from one drum to another. A number of such units can be used, in tandem, to treat the cans beginning from washing, rinsing and drying of the cans to heating, coating and drying of the coated cans.

21 Claims, 9 Drawing Figures

APPARATUS USED IN THE TREATMENT OF CANS

BACKGROUND OF THE INVENTION

The invention is useful in the treatment of hollow cylindrical metal cans having opposing ends, one of which is open and the other of which is closed, and especially in the cleaning, i.e. washing, rinsing and drying, of such cans.

U.S. Pat. Nos. 797,298 and 3,952,698 are typical of the many patents relating to apparatuses which utilize conveyors for supporting a number of cans as they are being treated. Such apparatuses are generally bulky and are confronted with the problem that occasionally cans topple over and become disoriented on the conveyor resulting in non-uniform treatment of the cans.

U.S. Pat. Nos. 3,302,655 and 3,861,409 are directed to apparatuses which employ mechanisms for rotating the cans about a horizontal axis, or in a vertical plane for treatment. It can be appreciated that liquid, used in the washing and rinsing of cans in such apparatuses, will remain in a can until the can passes through the vertically uppermost cycle of rotation. This is not the most desireable situation. The invention is directed to a different type of can treating apparatus in which the aforementioned problems are eliminated or substantially reduced.

Briefly stated, the invention is in an apparatus which is used in the treatment of hollow cylindrical containers or cans having a pair of opposing ends, one of which is open and the other of which is closed. The apparatus comprises at least one pair of cylindrical drums which are rotatable about vertically disposed, parallel axes. Means are provided for holding a number of containers, successively brought to one of the pair of cylindrical drums, adjacent the outer periphery in circumferential spaced horizontal alignment and in radially oriented relation to the rotational axes of the drums. Means are supplied for successively transferring the radially oriented containers from one drum to the other, when the containers on the one drum are rotated to a predetermined position adjacent the other drum. Means disposed exteriorly of each of the drums, are utilized for contacting the containers with fluid, under pressure, used in the treatment of the containers.

DESCRIPTION OF THE DRAWING

The following description of the invention will be better understood by having reference to the accompanying drawing, wherein.

DESCRIPTION OF THE INVENTION

Figure 1:
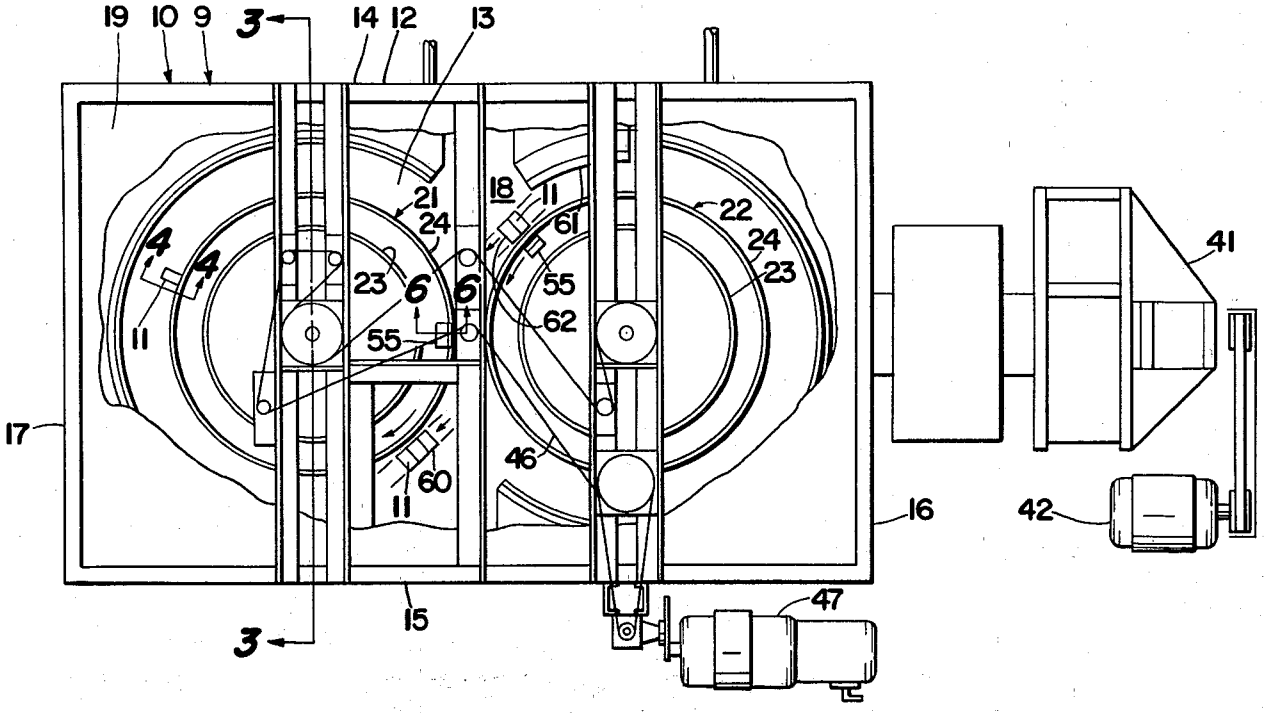
FIG. 1 is a plan view of an apparatus made in accordance with the invention with certain top portions removed to more clearly show the invention.
Figure 2:
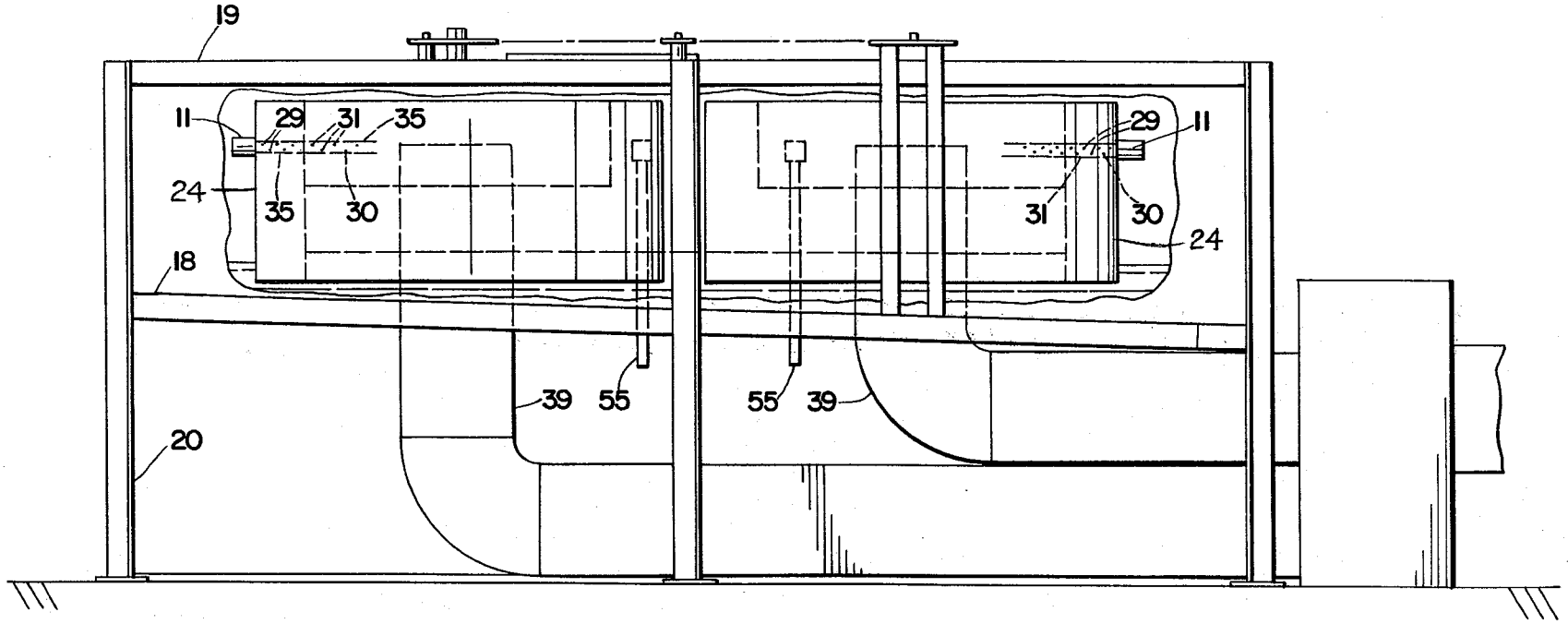
FIG. 2 is a side view of the apparatus with certain portions removed to more clearly show the invention.
Figure 3:
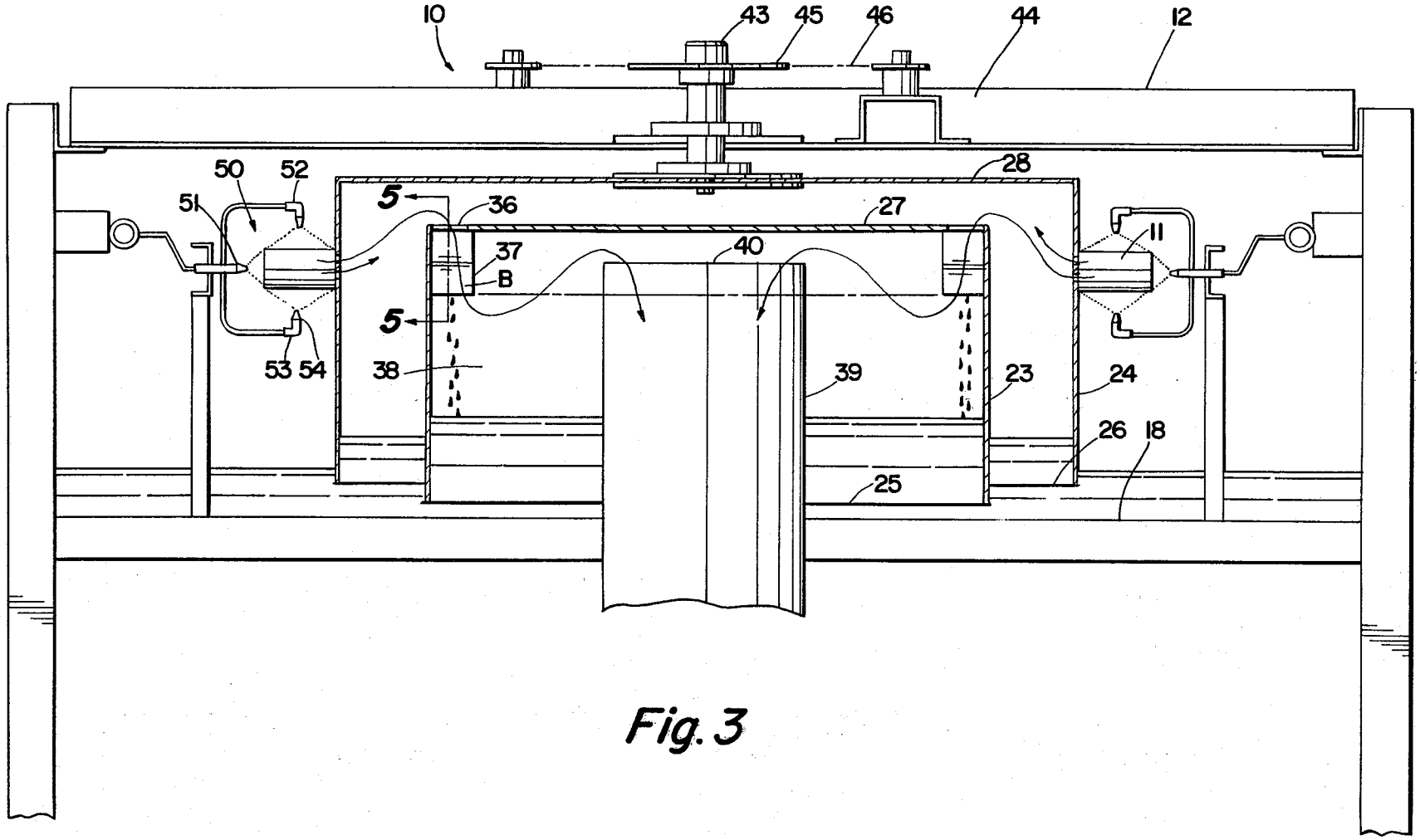
FIG. 3 is a section of the apparatus, as viewed from the line 3—3 of FIG. 1.

With reference to FIGS. 1–3, there is shown the basic unit 9 of an apparatus 10 used in the treatment of hollow cylindrical metal containers or cans 11 having a pair of opposing ends, one of which is open and the other of which is closed. This basic unit 9 can be combined with any number of similar units to provide, for example, a complete apparatus 10 for washing, rinsing, drying and coating such cans 11.

The basic unit 9 of the apparatus 10 essentially comprises a tank 12 having an enclosed chamber 13 which is bounded by a pair of opposing sidewalls 14,15, a pair of opposing end walls 16,17, a bottom floor 18, and a top cover 19. The tank 12 is horizontally disposed and supported on a number of similar legs 20. A pair of drums 21,22 are rotatably mounted in the chamber 13 of the tank 12 for rotation about parallel axes which are vertically disposed.

Each of the drums 21,22, as best seen in FIG. 3, comprises a fixedly disposed hollow inner cylinder 23 which is coincidental with a surrounding outer hollow cylindrical shell 24 that is rotatable about the inner cylinder 23. The inner cylinder 23 and outer shell 24 are rigid and composed of any suitable material, e.g. metal or plastic, and are similar in design in that they both have vertically lowermost bottom ends 25,26 which are open and spaced from the adjacent bottom floor 18 of the tank 12, and vertically uppermost closed tops 27,28 that are vertically spaced from the open bottom ends 25,26 and each other.

The outer shell 24, as best seen in FIGS. 2 and 3, is provided with a plurality of rows 29,30 of similarly sized, circumferentially spaced and aligned orifices 31 which are in predetermined spaced relation from each other, depending on the size of the cans 11. The orifices 31 of the adjacent rows 29,30 are vertically staggered circumferentially of the outer shell 24. It should be appreciated that a number of spaced pairs of rows of orifices can be provided where it is desireable to process a greater number of cans 11. Thus, instead of being capable of treating a single, circumferential line of cans 11, each of the drums 21,22 may be adapted to accommodate a plurality of rows of circumferentially aligned and spaced cans 11, as it is simply a matter of conveying the cans 11 to and from the drums 21,22 at different levels.

Figure 4:
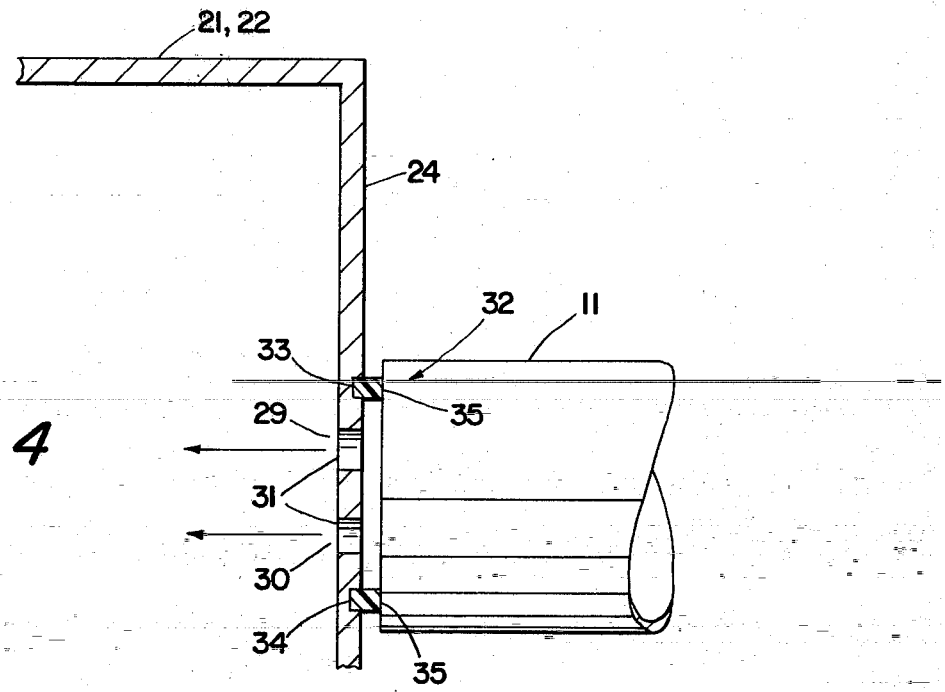
FIG. 4 is a section viewed from the line 4—4 of FIG. 1.

It can be appreciated that there will be two point contact of the open ends of the cans 11 with the rigid outer shell 24 and two point or, at most, single line contact between the closed ends of the cans 11 and adjacent curved outer surface of the shell 24 depending on whether the closed ends contain a recess. With reference to FIG. 4, there is shown a mechanism 32 for improving the contact between the cans 11 and each of the outer shells 24 of the drums 21,22. The mechanism 32 comprises a pair of annular recesses 33,34 which are disposed in parallel relation circumferentially of the outer shells 24 and sandwich the rows 29,30 of orifices 31 therebetween. A soft, resilient ring 35 of any suitable material not adversely effected by the liquid used in the treatment of the cans 11, is disposed in each of the recesses 33,34 and protrudes therefrom to engage the cans 11 and provide four point contact with the open and closed ends of the cans 11 as they are pressed against the rings 35, rather than the aforementioned limited two point contact.

Figure 5:
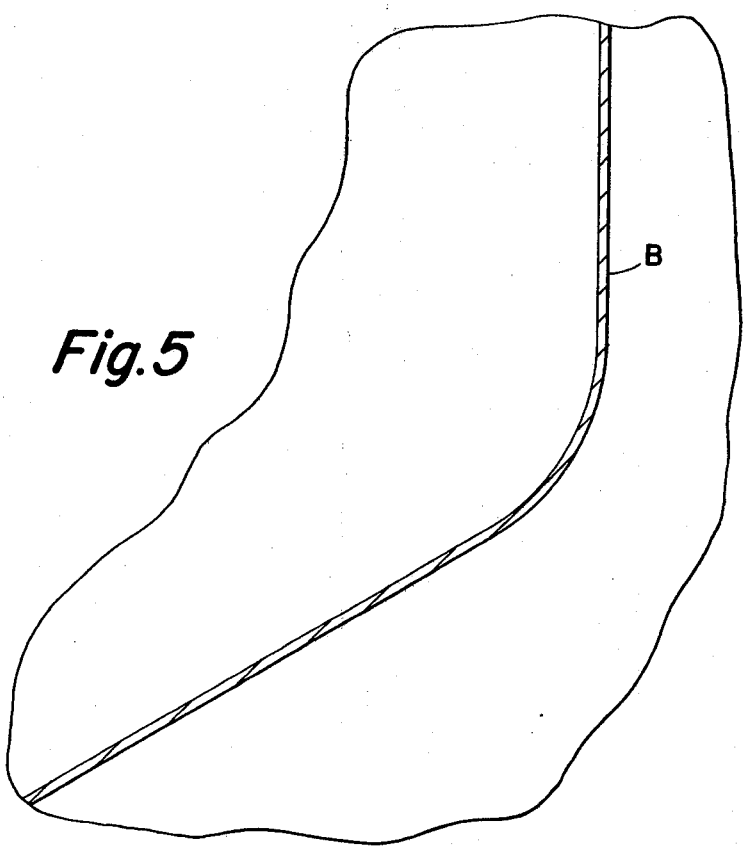
FIG. 5 is a section viewed from the line 5—5 of FIG. 3.

An annular opening 36, as best seen in FIG. 3, is disposed in the closed top 27 of each of the inner cylinders 23 and communicates with an annular fluid passageway 37 which is open to the hollow inside 38 of the inner cylinders 23. A plurality of similar shaped baffles B, as best seen in FIG. 5, are arcuately spaced around each of the fluid passageways 37 and are generally radially oriented relative to the longitudinal axes of the inner cylinders 23. The baffles B are specially configured to separate, by centrifugal force, droplets of water which are carried downwardly through the fluid passageways 37 by air from the orifices 31. A discharge pipe 39 is centrally disposed in each of the inner cylinders 23 and has an open end 40 spaced from the adjacent closed tops 28 of the inner cylinders 23. The discharge pipes 39 are in communication with a blower 41 (FIG. 1) which is operatively connected to an electric motor 42 that is used to operate the blower 41 to create a vacuum or suction within the discharge pipes 39 to draw air, exteriorly of the drums 21,22, inwardly through the orifices 31, then downwardly through the fluid passageways 37 where water is separated from the air which is then drawn into the discharge pipes 39 for exit to the ambient atmosphere, or reuse in some other component of the apparatus 10.

The closed tops 29 of the outer shells 24 are each secured to a centrally disposed shaft 43 which extends upwardly therefrom and is journalled for rotation in reinforcement angles 44 that span the chamber 13 laterally and are secured to the sidewalls 14,15 of the tank 12. The shafts 43 of the drums 21,22 are coupled by any suitable means, e.g. sprocket wheels 45 and chains 46, to an electric motor 47 (FIG. 1) which is used to drive or rotate the outer shells 24 of the drums 21,22 in unitary, synchronized relation.

Any suitable mechanism 50, as best seen in FIG. 3 can be utilized to direct against the cans 11, liquid used in the treatment of the cans 11, e.g. cleaning liquid to wash and rinse the cans 11. The mechanism 50, in this instance, comprises three sets 51,52,53 of similar nozzles 54 which are fixedly disposed and spaced in aligned relation circumferentially about each of the outer shells 24 adjacent the rows 29,30 of orifices 31. The first set 51 of nozzles 54 is positioned to direct streams or jets of liquid, under pressure, in radial directions against the cans 11 and outer shells 24. The other two sets 52,53 of nozzles 54 are positioned in opposed vertically spaced relation from the first set 51 of nozzles 54 and adjacent outer shells 24, to direct opposing jets of liquid, under pressure, towards each other and the cans 11 traveling or rotating therebetween. It can be appreciated that the nozzles 54 can be arranged in any particular pattern, depending on the desired treatment of the cans 11.

Figure 6:
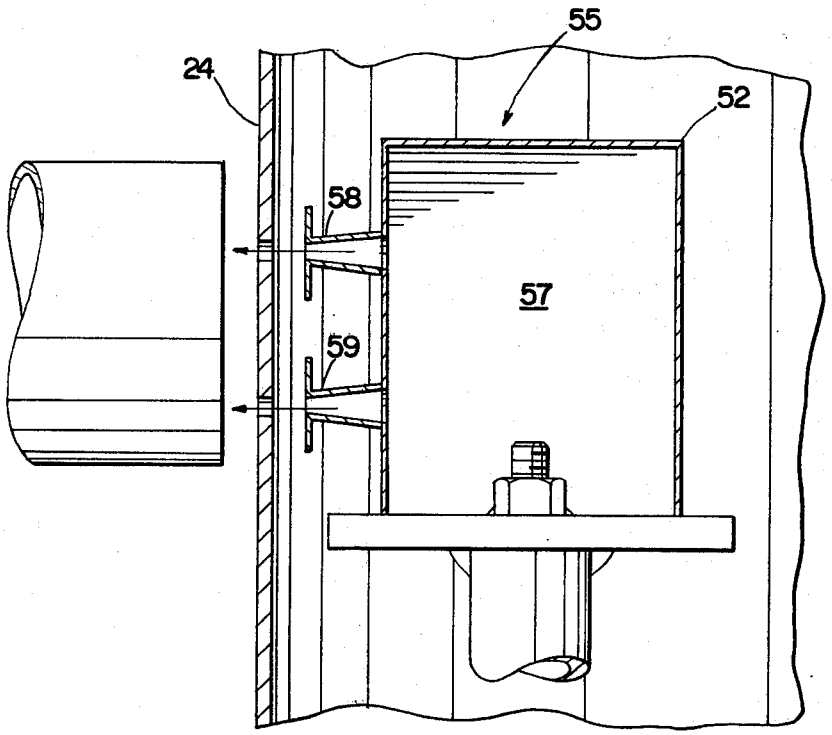
FIG. 6 is a section viewed from the line 6—6 of FIG. 1.

With reference to FIGS. 1 and 6, there is shown a blowoff device 55 used to successively transfer the cans 11 between adjacent pairs of drums, e.g. drums 21,22. The blowoff device 55, in this instance, is positioned between the inner cylinder 23 and outer shell 24 of the drum 21, first encountered by the cans 11, in a predetermined position relative to the other adjacent drum 22 to direct a stream or jet of air, under pressure, radially outwardly through the orifices 31 of the rows 29,30 to literally blow the cans 11 successively away from the outer shell 24 of the first-to-encounter drum 21 in the direction of the next-to-encounter drum 22 for pickup thereby adjacent the orifices 31. The blowoff device 55 comprises a housing 56 with an enclosed compartment 57 to which air from any suitable source, e.g. discharge pipes 39, is circulated, under pressure. A pair of nozzles 58,59 extend from the housing 56 in the direction of the adjacent outer shell 24, the longitudinal axes of the nozzles 58,59 being coaxially aligned with the circumferential centerlines of the rows 29,30 of orifices 31 for directing air, under pressure, from the compartment 56 through the adjacent orifices 31 as they pass before the nozzles 58,59. Similar blowoff devices 55 are also utilized to successively remove cans 11 from the last-to-encounter drums of the apparatus 10.

In operation, metal cans 11 are brought by any suitable conveyor 60 (FIG. 1) in properly radially oriented fashion to adjacent the first-to-encounter drum 21 for pickup and processing e.g. washing. Prior to this, the apparatus 10 has been made operational by circulating liquid, used in the washing of the cans 11, to the chamber 13 to fill the tank 12 to a level where the liquid is slightly higher than the open bottom ends 25,26 of the inner cylinder 23 and outer shell 24 to seal the bottom ends 25,26 and prevent the escapement of air from within the inner cylinder 23 and outer shell 24. The cans 11 are preferably brought to the first-to-encounter drum 21 such that the closed ends of the cans 11 are adjacent the outer shell 24 for pickup adjacent the orifices 31 by suction created thereat by the blower 41. The cans 11 are rotated between and adjacent the first three sets 51–53 of nozzles 54 which are used to spray and wash the inside of the cans 11 with washing liquid, after which the cans 11 are rotated to a position adjacent the second drum 22, where the blowoff device 55 blows each of the cans 11 successively towards the second drum 22 for pickup thereby. This time the open ends of the cans are adjacent the outer shell 24. Again, the cans 11 are rotated between and adjacent the second three sets 51–53 of nozzles 54 which are used to spray and wash the outside of the cans 11 with washing liquid. The cans 11, in this instance, are then rotated before a larger conventional blowoff nozzle 61 which directs air, under pressure, against the cans 11 to remove excess liquid used in the washing of the cans 11. Shortly thereafter the cans 11 are removed from the second drum 22 by a similar blowoff device 55 to the next succeeding drum or to an adjacent conveyor 62 for removal from the apparatus 10.

Figure 7:
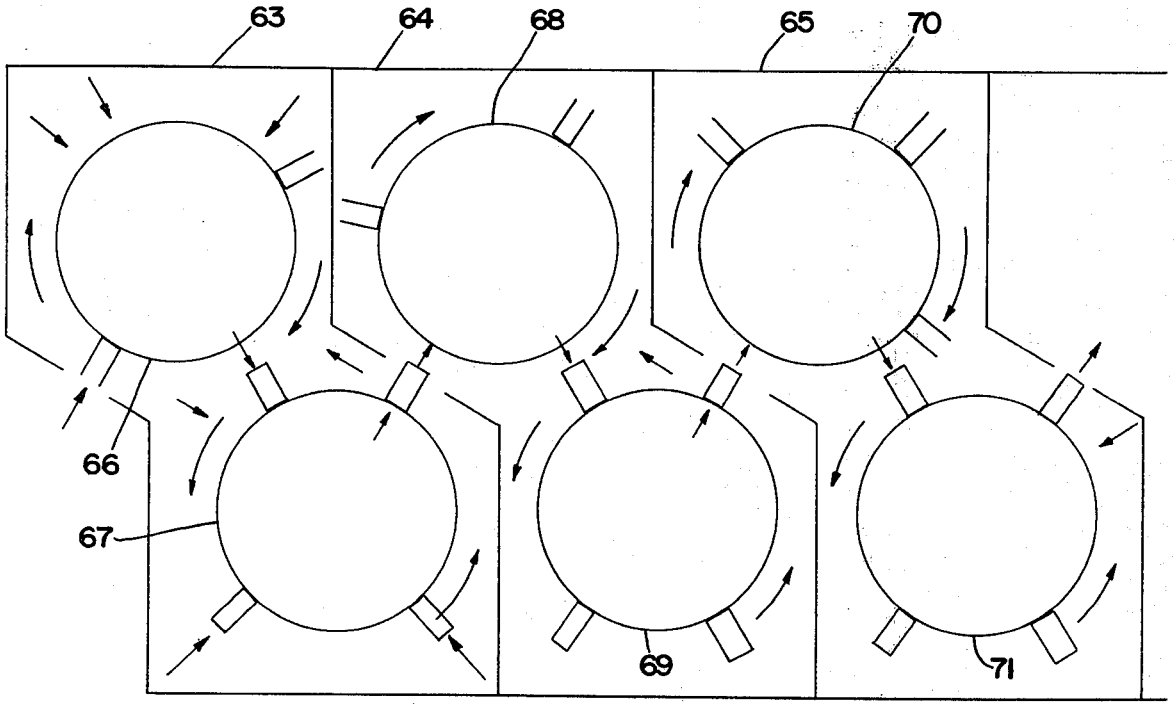
FIG. 7 is a schematic plan view of an apparatus used in the cleaning and coating of a can.

With reference to FIG. 7, there is shown a portion of an apparatus 10 which is comprised of a plurality of treatment stages of, for example, adjacently disposed units 63–65, each of which units comprises a pair of rotary drums similar to those described above. In this case, the cans 11 are successively charged to the first-to-encounter drum 66 of the first unit 63 where, for example, the inside of the cans are washed with any suitable liquid, after which the cans 11 are transferred by a blowoff device 55 to the last-to-encounter drum 67 of the first unit 63 where the outside of the cans are similarly washed.

The cans 11 are then successively transferred by a blowoff device 55 to the first-to-encounter drum 68 of the second unit 64 where, for example, the insides of the cans 11 are rinsed with any appropriate liquid, after which the cans 11 are similarly transferred to the last-to-encounter drum 69 of the second unit 64 where the outside of the cans 11 are rinsed.

The cans 11 are then successively transferred to the first-to-encounter drum 70 of the third unit 65 where, for example, the inside of the cans are chemically etched by any suitable etching solution, after which the cans 11 are transferred to the last-to-encounter drum 71 of the third unit 65 where the outside of the cans 11 are likewise etched. The cans 11 are transferred to any number of successive units (not shown) where they are further treated, for example, by rinsing, coating, etc. It can be appreciated that any number of basic units can be provided, depending on the desired treatment of the cans 11. Each unit or stage of the process, is accomplished by the use of two rotating drums where the inside and outside of the cans, held thereagainst, are similarly treated. It should be appreciated that a single unit can be adapted to perform a number of different processes, providing the tank is drained to accommodate the new liquid used in the treatment of the cans in a particular stage or cycle.

Figure 8:
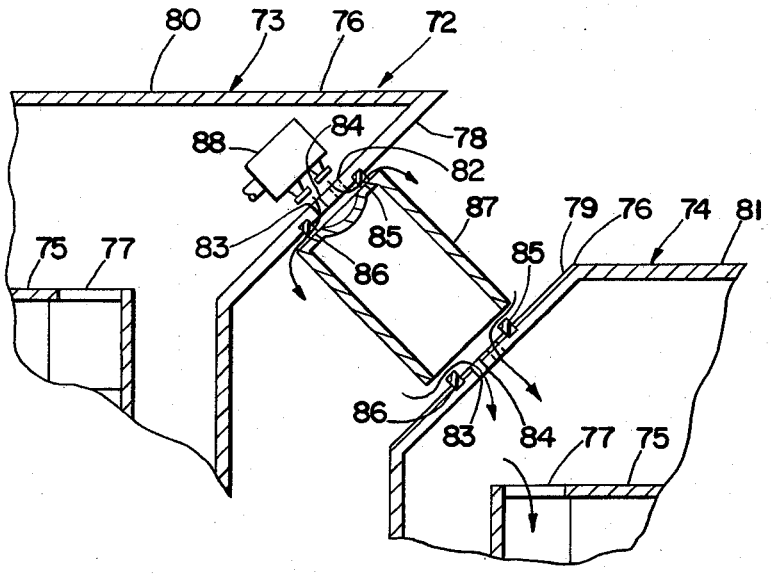
FIG. 8 is a portion of a section of another embodiment of the invention.

With reference to FIG. 8, there is shown another basic unit 72 which is essentially the same as the basic unit 9 of the apparatus 10 of FIGS. 1–6, except for the configuration of the outer shells of the rotary drums and the corresponding positioning of the cans relative thereto. The basic unit 72 is also comprised of a pair of adjacently disposed drums 73,74 which are rotatable about parallel, vertical axes and which include similar fixed inner cylinders 75 that are surrounded by hollow outer shells 76 which are mounted for rotation about the inner cylinders 75. The inner cylinders 75 are provided with similar annular openings 77 with baffles through which the mixtures of liquid and air enters the inner cylinders 75 and are separated as previously described.

The outer shells 76 of the drums 73,74 are provided with matingly configured inverted and upright frusto-conical portions 78,79 adjacent their closed tops 80,81, respectively. The frusto-conical portions 78,79 of the drums 73,74 are each provided with a plurality of circumferentially oriented rows 82,83 of spaced, similarly sized orifices 84 which are generally vertically staggered between a pair of parallel, resilient rings 85,86, against which the cans, e.g. can 87, rest as they rotate with the drums 73,74. Similar blowoff devices 88, are positioned to successively transfer the cans 87 from the inverted frusto-conical portion 78 of the first-to-encounter drum 73 to the upright frusto-conical portion 79 of the last-to-encounter drum 74 and to transfer the cans 87 from the last-to-encounter drum 74 onto a conveyor for removal or to another basic unit used in the further treatment of the cans.

Figure 9:
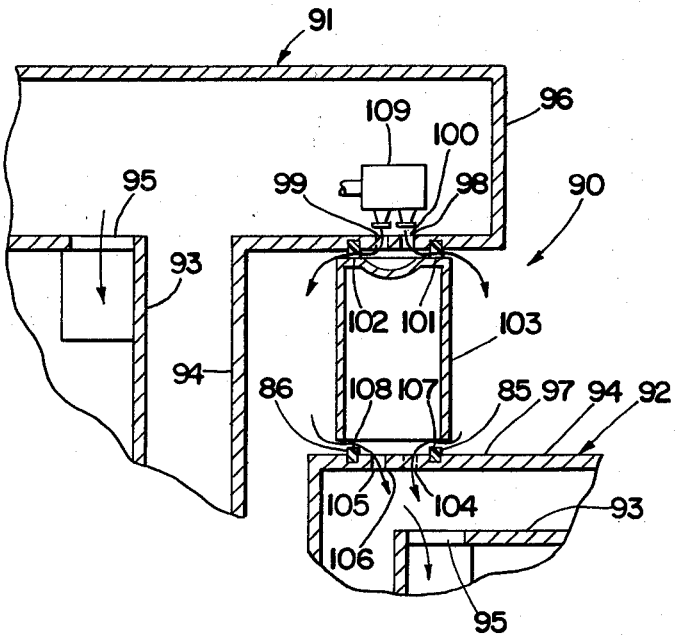
FIG. 9 is a portion of a section of still another embodiment of the invention.

With reference to FIG. 9, there is shown still another basic unit 90 which is essentially the same as the other basic units 9,72, except again, for the shape of the outer shells of the rotary drums and the corresponding locations of the cans relative thereto. The basic unit 90 is also comprised of a pair of rotary drums 91,92, each of which similarly includes a fixed cylinder 93 and a rotary outer shell 94. The inner cylinders 93 are each likewise provided with an annular opening 95 with baffles through which air enters the inner cylinders 93 as previously described. The outer shell 94 of the first-to-encounter drum 91 is generally cylindrical except for a hollow annular, cantilevered portion 96 which is spaced from, and overhangs an adjacent portion of the closed top 97 of the hollow cylindrical shell 94 of the other, last-to-encounter drum 92. The cantilevered portion 96 of the first drum 91 is provided with a plurality of spaced circular rows 98,99 of spaced, similarly sized orifices 100 which are again located in staggered relation between a pair of parallel circular resilient rings 101,102, which face, at the point of transfer of the cans, e.g. can 103, similar vertically aligned components of rows 104,105 of orifices 106 and resilient rings 107,108 located in the adjacent, vertically lower closed top 97 of the second drum 92 and against which the cans rest as they rotate successively with the two rotary drums 91,92. Similar blowoff devices 109 are also used for the purposes previously described.

It can be appreciated from a comparison of the basic units 9,72,90 of the drawing, that in all units, the cans are held against outer surfaces of rotary drums in positions where the cams rotate about vertical axes. In the units 9,72, the longitudinal axes of the cans are angularly disposed to the vertical axes. The cans in the embodiment of FIGS. 1–6 are radially oriented being held in a general horizontal position or at an angle of 90° to the rotary axes, whereas the cans in the embodiment of FIGS. 8 and 9 are maintained tilted downward in positions where the open ends of the cans face vertically downwardly so that any liquid entering the cans during the course of their treatment will always flow, by gravity, therefrom, so that no liquid will be retained within the cans to have a deleterious effect upon them.

The foregoing description has been in relation to the use of suction as a means for holding the cans in properly oriented relation adjacent the rotary drums, e.g. drums 21,22. In some instances, magnetism can be advantageously used to attract and hold cans effected by magnetism, adjacent the outer peripheries of the rotating drums 21,22, rather than suction created at orifices 31 by, for example, the blowers 41. This is best accomplished by the provision of a strong magnetic field circumferentially around the inner periphery of the outer shells of the drums 21,22. The cans can be transferred between adjacent drums by selectively controlling the magnetic field in the transfer area of the cans with or without the aid of a blowoff device as previously described. The magnetic field can be created by any suitable permanent magnetic or electromagnetic devices, e.g. permanent magnet device D shown in dotted line in FIG. 3, which are, preferably, stationary and adjacent the inner peripheries of the outer shells 24. An apparatus can be provided with alternate systems using magnetism and suction, if desired. The use of magnetism has certain advantages over suction. For example, the costly blowers and necessary ductwork, as well as the blowoff devices, can be eliminated when magnetism is used to maintain the cans adjacent the drums. However, magnetism would be unworkable with non-metallic cans or cans not affected by magnetism.

Thus, there has been described a unique apparatus that can be used in the treatment of hollow cylindrical metal cans having opposing open and closed ends. The apparatus comprises at least two drums which are rotatable about parallel, vertical axes and designed to rotate the cans in a horizontal plane about a vertical axis.

What is claimed is:

1. An apparatus used in the treatment of hollow cylindrical containers having a pair of opposing ends, one of which is open and the other of which is closed, comprising:

(a) means for holding a plurality of containers in equally spaced relation from a first axis and a second axis which are vertically disposed and parallel, and in such a way that the longitudinal axes of the containers are angularly oriented relative to the first and second axes;

(b) means for rotating the containers about the first axis in a horizontal pathway from a first position to an arcuately spaced second position while maintaining one end of the pair of opposing ends of each container closer to the first axis than the other end thereof;

(c) means for transferring the containers from the second position to a third position which is substantially opposite the second position;

(d) means for rotating the containers about the second axis in a horizontal pathway from the third position to an arcuately spaced fourth position while maintaining the other end of the pair of opposing ends of each container closer the second axis than the one end thereof;

(e) means for removing, the containers from the fourth position;

(f) means disposed adjacent the horizontal pathways which the containers travel between the first and second positions and the third and fourth positions, for contacting the containers with fluid, under pressure, used in the treatment of the containers;

the container holding means (a), including:

(I) a pair of drums rotatable about the first and second axes;

(II) a plurality of rows of orifices circumferentially spaced and horizontally aligned around each of the drums, the orifices of adjacent rows being staggered vertically around the drums;

(III) a pair of annular recesses disposed circumferentially of each of the drums and sandwiching a pair of adjacent rows of orifices therebetween;

(IV) a resilient elastomeric ring disposed in each of the recesses and protruding therefrom for engaging containers; and (V) means associated with the drums for drawing air exteriorly of the drums radially inwardly through the orifices into the interior of the drums, when the orifices and any containers held adjacent thereto are rotated between the first and second positions and the third and fourth positions.

2. The apparatus of claim 1, wherein the container transfer means (c) includes:

(VI) means associated with the drum rotatable about the first axis, for directing air, under pressure, radially outwardly through at least one of the orifices of the drum relative to the first axis thereof, when a container held adjacent the one orifice is in the second position.

3. The apparatus of claim 1, wherein the container contacting means (f) includes:

(VI) a first series of nozzles arcuately spaced at least partially around each of the drums and radially spaced from the peripheries thereof, for directing fluid, under pressure, radially against each of the drums in the direction of the orifices;

(VII) a second series of nozzles adjacent the nozzles of the first series, for directing fluid, under pressure, vertically downwardly against the containers held adjacent each of the drums in directions crosswise of the orifices;

and (VIII) a third series of nozzles adjacent the nozzles of the first series, for directing fluid, under pressure, vertically upwardly against the containers held adjacent each of the drums in directions crosswise of the orifices.

4. The apparatus of claim 1, which includes means for bringing a number of containers in radially oriented relation to a position adjacent and substantially opposite the first position for removal by the container holding means.

5. The apparatus of claim 1, which includes, means disposed interiorly of each of the drums for separating any liquid from air drawn inwardly through the orifices.

6. The apparatus of claim 1, which includes a plurality of pairs of similar drums positioned in staggered relation, means for carrying a number of containers successive to a position adjacent the drum first to be encountered by the containers for transfer thereto, and means for successively removing the containers from the drum last to be encountered by the containers.

7. An apparatus used in the treatment of hollow cylindrical containers having a pair of opposing ends, one of which is open and the other of which is closed, comprising:

(a) a tank having at least one chamber with a bottom floor therein;

(b) a pair of cylindrical drums disposed in the chamber;

(c) means mounting the pair of drums in the chamber for rotation about vertically disposed parallel axes;

(d) a plurality of rows of orifices disposed in each of the drums and circumferentially spaced therearound, the orifices in each row being horizontally aligned and the orifices of adjacent rows being vertically staggered;

(e) a pair of parallel annular recesses disposed circumferentially in each of the drums and sandwiching a plurality of rows of orifices therebetween;

(f) a resilient, elastomeric ring disposed in each of the recesses and protruding therefrom for contacting containers held adjacent the orifices;

(g) means for holding containers adjacent the orifices of each drum in positions where the longitudinal axes of the containers are radially oriented relative to the rotational axes of the drums, including means for drawing air from exteriorly of the drums, inwardly through the orifices and interiorly of the drums;

(h) means for blowing-off containers held adjacent the orifices, including means fixedly disposed relative to at least one of the rotatable drums, for directing air, under pressure, radially outwardly through the orifices in the direction of the other drum adjacent thereto, when the orifices of the one drum pass before the blow-off means;

(i) means coacting with each of the drums for separating liquid from air drawn inwardly through the orifices; and (j) means disposed exteriorly of each of the rotary drums for directing liquid, under pressure, against containers held adjacent the orifices as the containers move through a predetermined arcuate pathway around the rotational axes of the drums.

8. The apparatus of claim 7, wherein the liquid directing means (j) includes: a first set of nozzles arcuately spaced at least partially around each of the drums in radial spaced relation therefrom, for directing streams of liquid, under pressure, radially against the drums in the direction of the orifices; and two other sets of oppositely disposed nozzles which are disposed adjacent the nozzles of the first set of nozzles, for directing opposing streams of liquid, under pressure, vertically against containers in directions crosswise of the orifices.

9. The apparatus of claim 8, wherein each drum includes: a hollow, inner cylinder fixedly disposed interiorly of a hollow cylindrical outer shell which is rotatable about the inner cylinder, the inner cylinder and outer shell each having an open bottom spaced from the bottom floor of the chamber and a closed top spaced from an adjacent top of the tank; and the container holding means (g) and the liquid separating means (i) include:

(I) a discharge pipe centrally disposed vertically within each of the inner cylinders and having an open end spaced from the closed end of an adjacent inner cylinder;

(II) an annular opening disposed in the closed top of each of the inner cylinders in radially spaced relation from the open end of the discharge pipe;

(III) an annular fluid passageway communicating with each of the annular openings and extending downwardly therefrom interiorly of the inner cylinders, each of the fluid passageways including a plurality of arcuately spaced baffles which are radially oriented relative to the longitudinal axes of the inner cylinders and which are configured to separate by centrifugal force, liquid in the air as the air flows downwardly between the baffles into the spaces between the discharge pipes and inner cylinders; and (IV) means coacting with the discharge pipes for drawing air through the discharge pipes in directions away from the closed tops of the inner cylinders.

10. The apparatus of claim 9, which includes means for circulating liquid, used in the treatment of the containers, into the chamber to a level where the liquid is vertically above the bottom open ends of the inner cylinders and outer shells.

11. The apparatus of claim 10, which includes means for carrying containers successively to a position adjacent the one drum in radially oriented relation relative to the rotational axis of the one drum.

12. The apparatus of claim 11 which includes a plurality of similar tanks disposed, in tandem, each of the tanks including a similar pair of drums for treating the insides and outsides of the containers.

13. An apparatus used in the treatment of hollow cylindrical containers having a pair of opposing ends, one of which is open and the other of which is closed, comprising:

(a) a pair of spaced drums rotatable about parallel vertically disposed axes;

(b) means for holding a plurality of containers adjacent opposing outer surfaces of the drums, such that the containers held by the drums rotate in substantially horizontal planes and about rotational axes of the drums, including means for positioning the containers so that the open ends thereof face one of the pair of drums and the closed ends thereof face the other of the pair of drums and such that the longitudinally axes of the containers are substantially parallel to the rotational axis of the drum against which the containers are held;

(c) means for successively transferring the containers between the opposing outer surfaces of the drums so that the interior of the containers will be treated when the containers are held adjacent one of the drums and the exterior of the containers will be treated when the containers are held adjacent the other of the drums;

the drum of the pair of drums second-to-be encountered by the containers including:

(d) a first stationary inner cylinder having at least one opening therein and a fluid passageway communicating with the opening;

(e) a first, hollow outer shell surrounding the inner cylinder and rotatable therearound, the shell being generally cylindrical and having a closed top spaced vertically above the inner cylinder; and the container holding means including:

(f) at least one substantially circular row of spaced orifices disposed in a portion of the closed top of the outer shell adjacent the outer cylindrical periphery thereof; and (g) means for drawing air, exteriorly of the outer shell, interiorly of the outer shell and inner cylinder through the orifices, opening and fluid passageway thereof;

the drum of the pair of drums first-to-be encountered by the containers, including:

(h) a second stationary inner cylinder having at least one opening therein and a fluid passageway communicating with the opening;

(i) a second hollow outer shell surrounding the second inner cylinder and rotatable therearound, the second shell having a closed top spaced vertically above the second inner cylinder and being generally cylindrical except for a hollow, annular cantilevered portion which is designed to partially overhang a portion of the orifice containing portion of the closed top of the second-to-be encountered drum; and the container holding means also includes;

(j) at least one substantially circular row of spaced orifices disposed in the cantilevered portion in correlated relation to the disposition of the orifices in the closed top of the second-to-be encountered drum; and (k) means for drawing air, exteriorly of the second outer shell, interiorly of the second shell and second inner cylinder therein through the orifices, opening, and fluid passageway thereof.

14. An apparatus used in the treatment of hollow cylindrical containers having a pair of opposing ends, one of which is open and the other of which is closed, comprising:

(a) a pair of spaced drums rotatable about parallel vertically disposed axes;

(b) means for holding a plurality of containers adjacent opposing outer surfaces of the drums, such that the containers held by the drums rotate in substantially horizontal planes and about rotational axes of the drums, including means for positioning the containers so that the open ends thereof face one of the pair of drums and the closed ends thereof face the other of the pair of drums and such that the longitudinal axes of the containers are angularly disposed to the rotational axis of the drum against which the containers are held;

(c) means for successively transferring the containers between the opposing outer surfaces of the drums so that the interior of the containers will be treated when the containers are held adjacent one of the drums and the exterior of the containers will be treated when the containers are held adjacent the other of the drums;

the drum of the pair of drums second-to-be encountered by the container, including:

(d) a first stationary inner cylinder having at least one opening therein and a fluid passageway communicating with the opening;

(e) a first, hollow outer shell surrounding the inner cylinder and rotatable therearound, the shell being generally cylindrical and having a closed top spaced vertically above the inner cylinder; and the container holding means including:

(f) at least one row of substantially aligned orifices spaced circumferentially around the drum; and (g) means for drawing air, exteriorly of the outer shell, interiorly of the outer shell and inner cylinder through the orifices, opening, and fluid passageway thereof;

the drum of the pair of drums first-to-be encountered by the containers, including:

(h) a second stationary inner cylinder having at least one opening therein and a fluid passageway communicating with the opening;

(i) a second hollow outer shell surrounding the second inner cylinder and rotatable therearound, the second outer shell being generally cylindrical and having a closed top spaced vertically above the second inner cylinder; and the container holding means, also includes:

(j) at least one row of substantially aligned orifices spaced circumferentially about the second outer shell in correlated relation to the disposition of the orifices in the first outer shell; and (k) means for drawing air, exteriorly of the second outer shell, interiorly of the second shell and second inner cylinder therein through the orifices, opening, and fluid passageway thereof.

15. An apparatus used in the treatment of hollow cylindrical containers having a pair of opposing ends, one of which is open and the other of which is closed, comprising:

(a) a pair of spaced drums rotatable about parallel vertically disposed axes;

(b) means for holding a plurality of containers adjacent opposing outer surfaces of the drums, such that the containers held by the drums rotate in substantially horizontal planes and about rotational axes of the drums, including means for positioning the containers so that the open ends thereof face one of the pair of drums and the closed ends thereof face the other of the pair of drums and such that the longitudinal axes of the containers are angularly disposed to the rotational axis of the drum against which the containers are held;

(c) means for successively transferring the containers between the opposing outer surfaces of the drums so that the interior of the containers will be treated when the containers are held adjacent one of the drums and the exterior of the containers will be treated when the containers are held adjacent the other of the drums;

the drum of the pair of drums second-to-be encountered by the container, including:

(d) a first stationary inner cylinder having at least one opening therein and a fluid passageway communicating with the opening;

(e) a first hollow outer shell surrounding the inner cylinder and rotatable therearound, the shell having a closed top spaced vertically above the inner cylinder and being generally cylindrical except for a hollow, upright frusto-conical portion adjacent the closed top of the shell;

and the container holding means, including:

(f) at least one row of orifices spaced circumferentially around the upright frusto-conical portion in spaced relation from the closed top of the shell; and (g) means for drawing air, exteriorly of the outer shell, interiorly of the outer shell and inner cylinder through the orifices, opening, and fluid passageway thereof;

the drum of the pair of drums first-to-be encountered by the containers, including:

(h) a second stationary inner cylinder having at least one opening therein and a fluid passageway communicating with the opening;

(i) a second hollow outer shell surrounding the second inner cylinder and rotatable therearound, the second outer shell having a closed top spaced vertically above the second inner cylinder and being generally cylindrical except for an inverted frusto-conical portion adjacent the closed top of the second outer shell, the inverted frusto-conical portion designed to partially overhang a portion of the upright frusto-conical portion so that containers can be transferred therebetween; and the container holding means also includes:

(j) at least one row of orifices spaced circumferentially around the inverted frusto-conical portion in spaced relation from the closed top of the second outer shell and in correlated relation to the disposition of the orifices in the upright frusto-conical portions; and (k) means for drawing air, exteriorly of the second outer shell, interiorly of the second shell and second inner cylinder therein through the orifices, openings, and fluid passageways thereof.

16. The apparatus of claim 14, which includes means for transferring containers from the second outer shell of the drum first-to-be encountered by the containers to the first outer shell of the drum second-to-be encountered by the containers.

17. The apparatus of claim 16, wherein the means for transferring containers includes means disposed at a point within the second outer shell where the second outer shell is closest the first outer shell, for blowing air outwardly through the orifices in the second shell in the direction of the first shell.

18. The apparatus of claim 17, which includes means disposed exteriorly of the outer shells for contacting containers with a treatment fluid as they rotate with the drums.

19. The apparatus of claim 18, wherein each drum includes a plurality of vertically spaced rows of orifices in the outer shell thereof, each plurality of rows of orifices being sandwiched between a pair of annular recesses in the outer peripheries of the shells, the recesses each containing a resilient elastomeric ring which protrudes from the recesses for engaging containers drawn against the outer shells.

20. The apparatus of claim 19, which includes means disposed interiorly of the inner cylinders for separating liquid from air drawn inwardly of the orifices in the direction of the inner cylinders.

21. The apparatus of claim 20, wherein the container holding means includes means for holding the containers such that their longitudinal axes are normal to the rotational axis of the drum holding the containers.

* * * * *